US010993517B2

(12) United States Patent
Ma et al.

(10) Patent No.: US 10,993,517 B2
(45) Date of Patent: May 4, 2021

(54) SUITCASE WITH A DETACHABLE PORTION

(71) Applicant: HIGH HOPE ZHONGDING CORPORATION, Jiangsu (CN)

(72) Inventors: Tao Ma, Nanjing (CN); Wei Chen, Nanjing (CN)

(73) Assignee: HIGH HOPE ZHONGDING CORPORATION, Jiangsu (CN)

( * ) Notice: Subject to any disclaimer, the term of this patent is extended or adjusted under 35 U.S.C. 154(b) by 74 days.

(21) Appl. No.: 16/055,369

(22) Filed: Aug. 6, 2018

(65) Prior Publication Data

US 2019/0387854 A1 Dec. 26, 2019

(30) Foreign Application Priority Data

Nov. 27, 2017 (CN) ..... 201711203223.8
Nov. 27, 2017 (CN) ..... 201721604679.0

(51) Int. Cl.

| | |
|---|---|
| ***A45C 5/03*** | (2006.01) |
| ***A45C 13/10*** | (2006.01) |
| ***A45C 13/00*** | (2006.01) |
| ***A45C 5/14*** | (2006.01) |

(52) U.S. Cl.

CPC ..... *A45C 13/002* (2013.01); *A45C 5/03* (2013.01); *A45C 5/14* (2013.01); *A45C 13/001* (2013.01); *A45C 13/10* (2013.01)

(58) Field of Classification Search

CPC .... A45C 5/06; A45C 5/03; A45C 5/00; A45C 5/14

See application file for complete search history.

(56) References Cited

U.S. PATENT DOCUMENTS

| | | | | |
|---|---|---|---|---|
| 3,394,838 A * | 7/1968 | Larkin | A45C 12/1092 220/326 |
| 4,693,345 A * | 9/1987 | Mittelmann | A45C 7/02 190/108 |
| 6,048,005 A * | 4/2000 | Rotondi | E05C 17/14 292/262 |
| 2007/0125815 A1* | 6/2007 | Tong | A45F 4/02 224/153 |

FOREIGN PATENT DOCUMENTS

| | | | |
|---|---|---|---|
| JP | 3211054 U * | 6/2017 | A45C 13/00 |
| WO | WO-2017103695 A1 * | 6/2017 | A45F 3/04 |

OTHER PUBLICATIONS

Machine Translation of JP3211054U (Year: 2020).*

* cited by examiner

*Primary Examiner* — Nathan J Newhouse
*Assistant Examiner* — Justin Caudill
(74) *Attorney, Agent, or Firm* — Hudak, Shunk & Farine Co. LPA

(57) ABSTRACT

A suitcase including: a suitcase main body with an upper side and a lower side, wherein a concaved cavity is provided in at least one of the upper side and the lower side, a bottom wall of the concaved cavity is provided with at least one assembly hole, and a top end of the main body is provided with a lock, the suitcase further including a detachable portion and a bottom stopper; wherein when the detachable portion is put in place and secured within the concaved cavity, at least a part of the detachable portion is confined within an inner space defined by the front stop and the bottom stop of the bottom stopper. The detachable portion of the suitcase can be readily replaced depending upon the needs of a user, which is more convenient for use.

13 Claims, 14 Drawing Sheets

SUITCASE WITH A DETACHABLE PORTION

FIELD OF THE INVENTION

The present invention relates to a suitcase. More specifically, the present invention relates to a suitcase with a detachable portion. The detachable portion of the suitcase of the present invention can be readily replaced depending upon the needs of a user, which is more convenient for use, and more humane.

TECHNICAL BACKGROUND OF THE INVENTION

Current suitcases are typically formed of two portions formed of hard materials, with a part of one portion being pivotedly coupled to a part of the other portion, while the remaining part of one portion being releasably coupled to the remaining part of the other portion by a releasable fastening means, such as a zipper, to form the main body of a suitcase. Then, some accessories can be incorporated to form a complete suitcase. Generally, articles are received in an inner space of the main body of such a suitcase, and thus the functionality thereof is not so good, and it is not convenient to take out or put in the articles.

Conventional traveling suitcases with outer bags are simple wherein the outer bag is attached to the main body of the suitcase (a movable PE plate may be provided in the inner space to separate the outer bag from the main body). In this case, the articles in the outer bag may be pressed against other articles in the suitcase and may also move around. Therefore, the outer bag is not truly separated from the suitcase. Additionally, the outer bag is flexible and loose in shape. Accordingly, such an outer bag gives the user a feeling of not strong and safe enough.

In view of working and living needs of people of different professions, different people may take with them different articles. Therefore, the functions of an outer bag should be with a significant flexibility. For example, for an actress, she may need touch-ups when waiting for a flight, so it would be necessary that the outer bag serves as a personal makeup bag with multiple pockets for accommodating different cosmetics and tools. Another example, for a tour guide, it would be required that the outer bag design is focused mainly on storing different documents (such as, for example, the passports of the members) as well as commonly used medicines and tools. While for a cartoonist, the outer bag should be able to store various type of painting brushes, drawing boards, and so forth, so that the cartoonist can work at any place and any time during the journey. In the course of travelling, it is generally tedious taking vehicles to the destination and getting back, so it would be an important aspect to be considered by a suitcase user whether to doze frequently or be able to take out his/her own tools conveniently and quickly from the suitcase and use them.

Accordingly, in the art, a suitcase that can meet different needs of a user, easy to use and more humane, is still required.

SUMMARY OF THE INVENTION

In consideration of the flaws present in current suitcases, the inventors designed a novel suitcase. This novel suitcase has a detachable portion, and with the detachable portion, suitcase components of different functions, such as different outer bags can be replaced and loaded onto the suitcase, thereby satisfying the multi-functional requirements of a user.

In order to achieve the above objective, the suitcase with a detachable portion of the present invention comprises a suitcase main body with an upper side and a lower side, wherein a concaved cavity is provided in at least one of the upper side and the lower side, a bottom wall of the concaved cavity is provided with at least one assembly hole, and a top end of the main body is provided with a locking means, the suitcase further comprising: a detachable portion having a shape and size adapted to the concaved cavity, and the detachable portion having a top end that is provided with a securing mechanism; a bottom stopper including at least a front stop and a bottom stop that is joined with the front stop, the bottom stop has a lower surface that is provided with at least one projection; wherein when the detachable portion is put in place and secured within the concaved cavity, at least a part of the detachable portion is confined within an inner space defined by the front stop and the bottom stop of the bottom stopper, and the at least one projection on the lower surface of the bottom stop is secured within the at least one assembly hole; the securing mechanism at the top end of the detachable portion is releasably secured into the locking means.

In one embodiment, the bottom wall of the concaved cavity is provided with two assembly holes.

In one embodiment, the securing mechanism at the top end of the detachable portion comprises at least one inserting piece, and the locking means is at least one locking slot engaged with the at least one inserting piece.

In one embodiment, the projection is of a hollow structure and the outer size of the projection is greater than the inner size of the assembly hole, and the projection is formed of an elastic material.

In one embodiment, the inserting piece is of a hollow structure and the outer size of the inserting piece is greater than the inner size of the locking slot, and the inserting piece is formed of a wear-resistant elastic material.

In one embodiment, the securing mechanism comprises a securing belt having one end connected to the top end of the detachable portion, and the other end of the securing belt is fixedly connected with the inserting piece.

In one embodiment, the inserting piece is of a solid structure and the locking slot is provided with an elastic piece therein for securing the inserting piece.

In one embodiment, two inserting pieces and two corresponding locking slots are provided.

In a preferred embodiment, a back side of the detachable portion and a back portion of the concaved cavity are provided with corresponding releasable locking means that have not been engaged with one another.

Another aspect of the invention is that the detachable portion and the main body of the suitcase are in the disconnected state.

In one embodiment, the securing mechanism at the top end of the detachable portion comprises a ring-shaped insert piece, a support piece, a fastening screw and a rigid plate, the ring-shaped insert piece is fixedly attached to the support piece, and secured, using the support piece and the fastening screw, to the back side of the top end of the detachable portion by means of the rigid plate; the locking means being a lockset having a lock hole to be engaged with the ring-shaped insert piece.

Preferably, the lockset comprises a switch having a first position and a second position; in the first position, the ring-shaped insert piece is locked into the lock hole of the lock set, and when the switch is moved from the first position to the second position, the ring-shaped insert piece is unlocked into the lock hole of the lockset.

Preferably, the rigid plate is an aluminum plate, and the aluminum plate is secured to the back side of the top end of the detachable portion.

The detachable portion of the suitcase of the present invention can be easily secured within the concaved cavity of the suitcase and can also be detached therefrom. Accordingly, the detachable portion can be used to achieve multi-functions required by a user. For example, when working, an actress can select a detachable portion having particular functions, e.g., the detachable portion is used primarily for storing various cosmetics and tools. While when traveling for a vacation, the actress may replace the detachable portion with another type, such as a soft bag that is used primarily for storing books, medicines, or photographic supplies. As such, with one suitcase main body, different requirements of a user can be satisfied. The same suitcase main body can even be used by different family members, and the only thing needs to do is to replace with a different detachable portion to meet the particular needs of a different user. Therefore, the suitcase with a detachable portion of the present invention is of a significant convenience and makes the suitcase more humane.

BRIEF DESCRIPTION OF THE DRAWINGS

The present invention will be better understood by reading the detailed description below by referring to the accompanying drawings, and the other features and advantages will also become apparent, in which:

FIG. 6B is to be completely assemble to the suitcase main body with the bottom stopper, wherein the location of the securing mechanism is particularly shown; FIG. 6B is to be completely assemble to the suitcase main body with the bottom stopper, wherein the location of the lock hole of the lockset to be engaged with the securing mechanism is particularly shown.

DETAILED DESCRIPTION OF THE INVENTION

Figure 1:
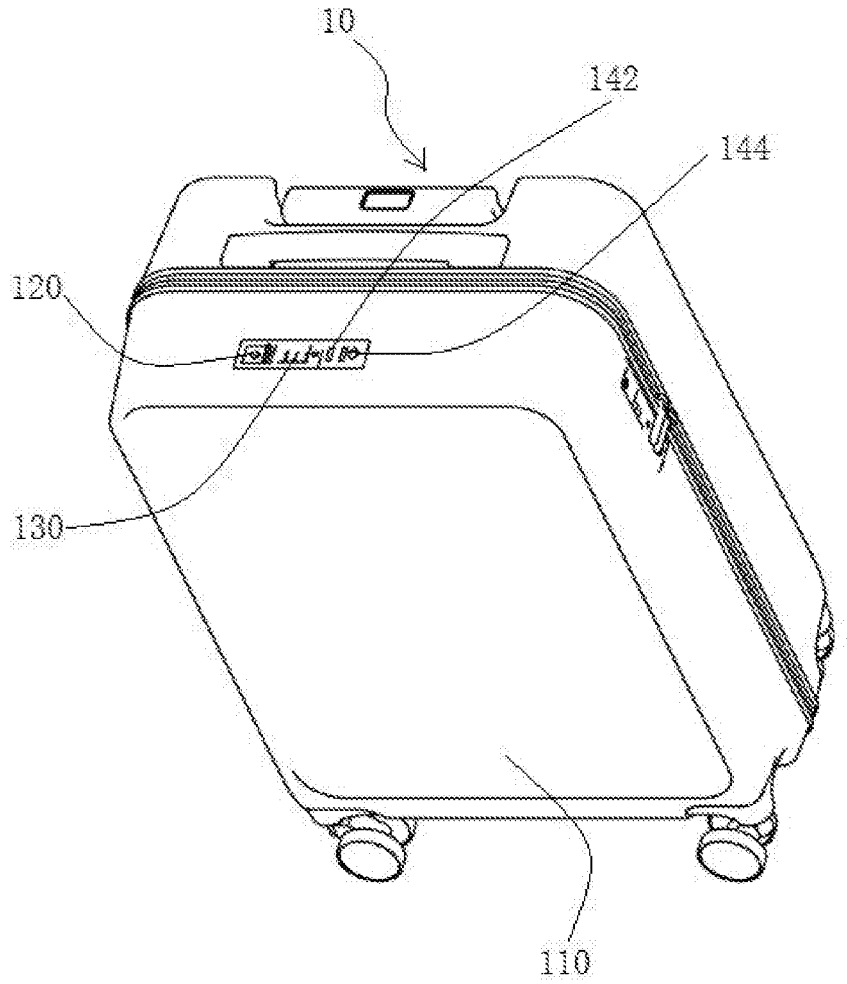
FIG. 1 is a schematic perspective diagram of the main body portion of the suitcase with a detachable portion of the present invention, wherein a concaved cavity for receiving the detachable portion is illustrated, but the detachable portion has not yet been received therein.
Figure 2A:
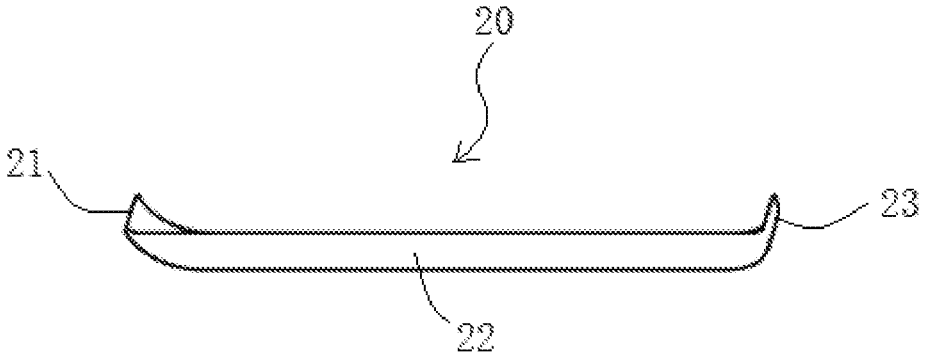
FIG. 2A illustrates a schematic perspective diagram of a bottom stopper of the present invention.
Figure 2B:
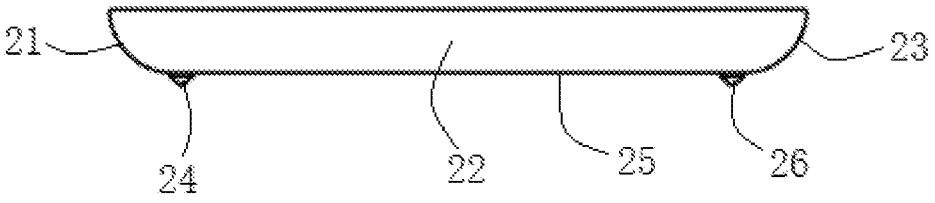
FIG. 2B illustrates a front view of the bottom stopper of FIG. 2A.

The present invention will be further described by referring to the accompanying drawings for a better understanding. It should be understood that the embodiments illustrated in the drawings are for description of the invention only and shall not be construed as any limitation to the present invention. The scope of the invention would rather be defined by the appended claims.

It should also be understood that the directional terms such as "upper", "lower", "left", "right", "front", "rear", "top", "bottom", "back side", "back portion", or the like that may be used herein are merely for the ease of describing the present invention, and they should not be construed as limitations to the present invention in any way. It should be further understood that a feature described in a single form may also be used in plural form, that is to say, the present invention may include one or more of such features.

It should be understood that the accompanying drawings are merely used to illustrate the present invention, and not necessarily drawn in scale, and they should not be construed as limiting the present invention in any inappropriate way.

FIG. 1 is a schematic perspective diagram of the main body portion of the suitcase with a detachable portion of the present invention, wherein a concaved cavity for receiving the detachable portion is illustrated, but the detachable portion has not yet been received therein. As shown in FIG. 1, the suitcase of the present invention comprises a suitcase main body 10. Different from the current suitcase main body, the suitcase main body 10 has a concaved cavity 110 in one side thereof (for example, in the upper side or in the lower side of the suitcase), and is provided with locking slots 142, 144 near the customs lock 120 and the combination lock 130.

As used herein, the lower side refers to the side of the main body 10 which contacts the ground and the upper side refers to the side opposite the lower side, when the suitcase is laid flat on the ground. This is different from the state that the wheels of the suitcase stand vertically on the ground.

Figure 3A:
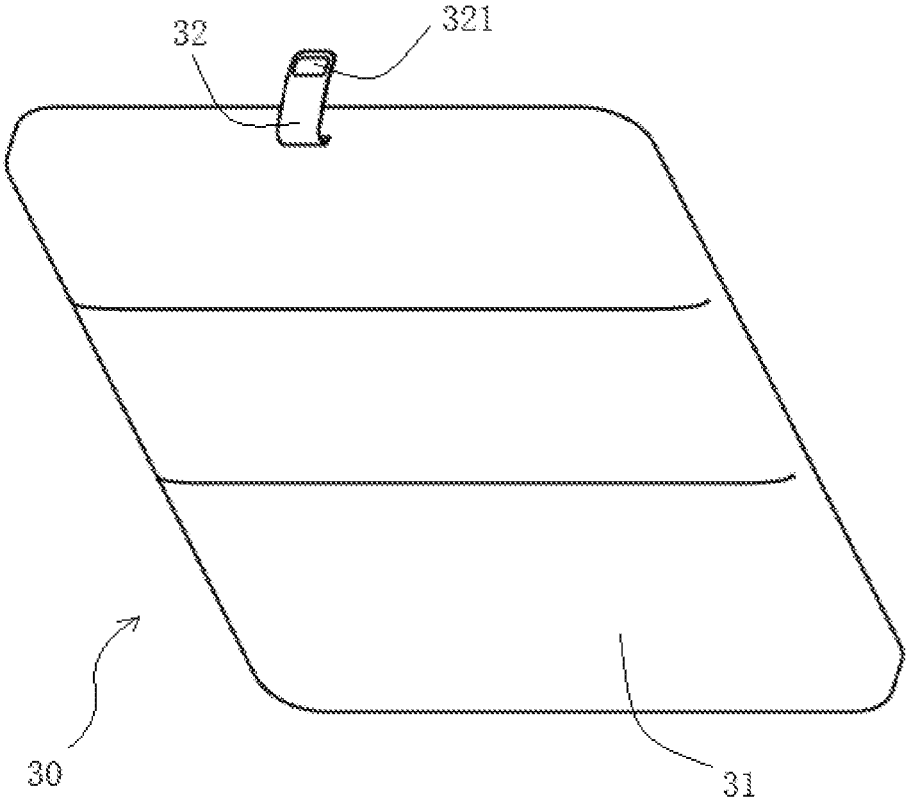
FIG. 3A illustrates a schematic perspective diagram of a detachable portion of the present invention.
Figure 3B:
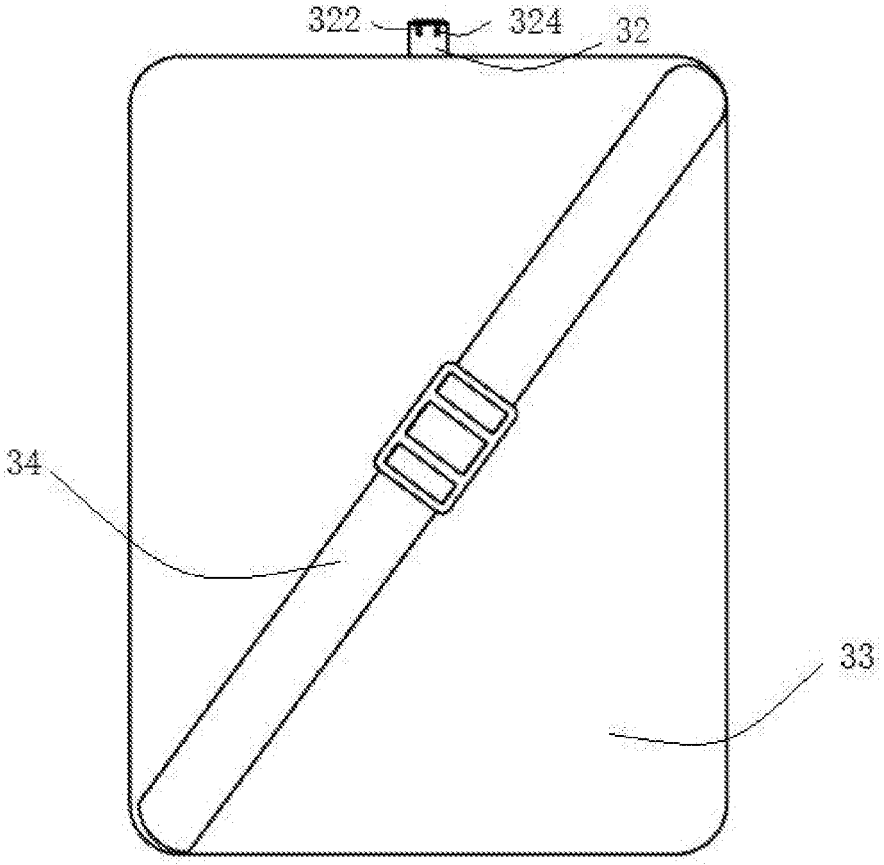
FIG. 3B illustrates a rear view of the detachable portion of the present invention.
Figure 4A:
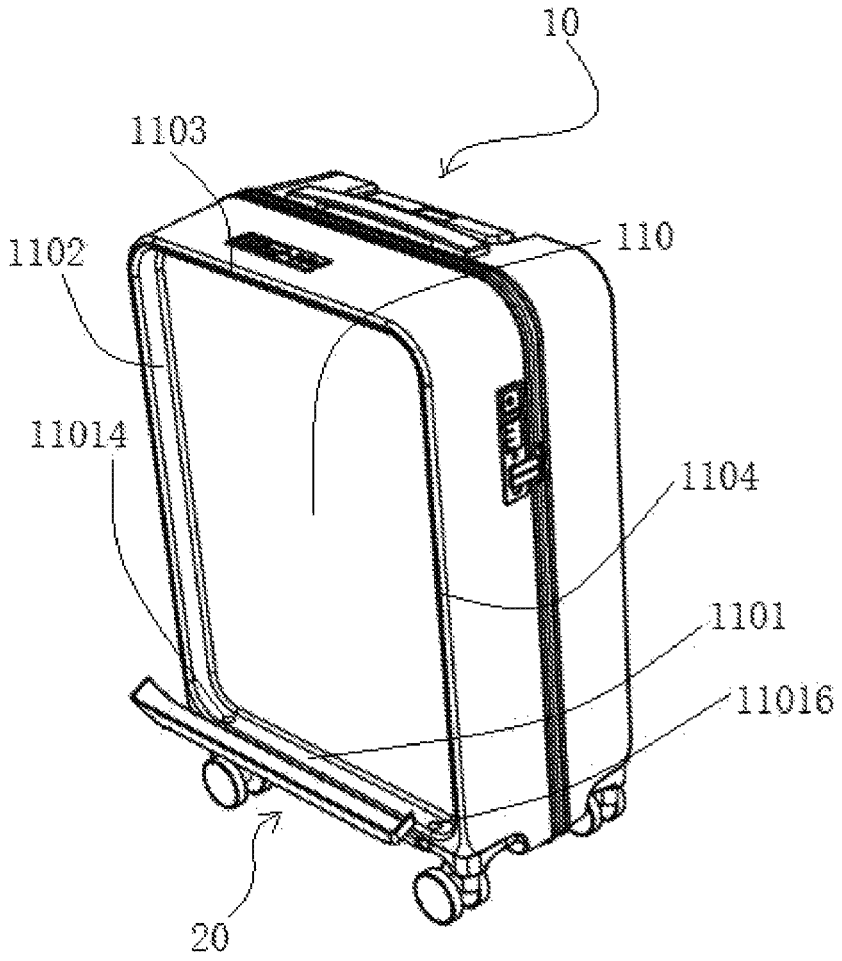
FIG. 4A illustrates the state that the bottom stopper has not yet been assembled onto the main body portion of the suitcase of the present invention.
Figure 4B:
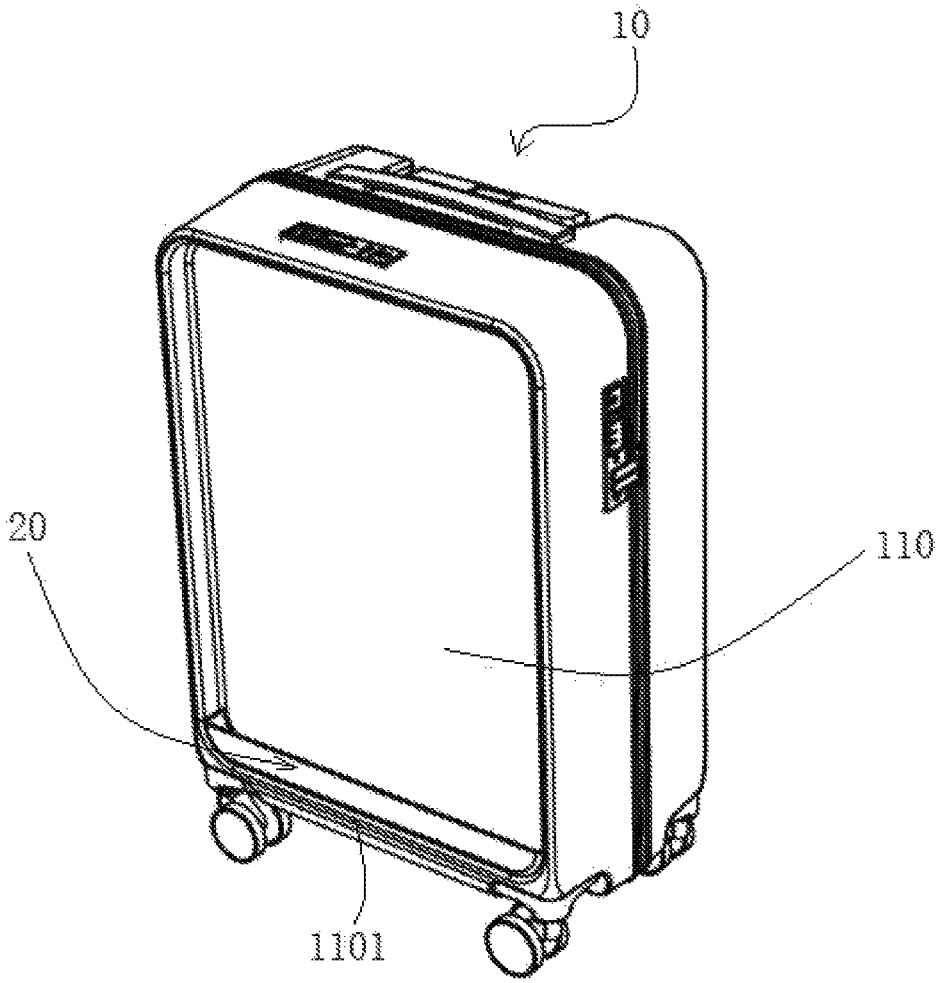
FIG. 4B illustrates the state that the bottom stopper has been assembled onto the main body portion of the suitcase of the present invention.
Figure 4C:
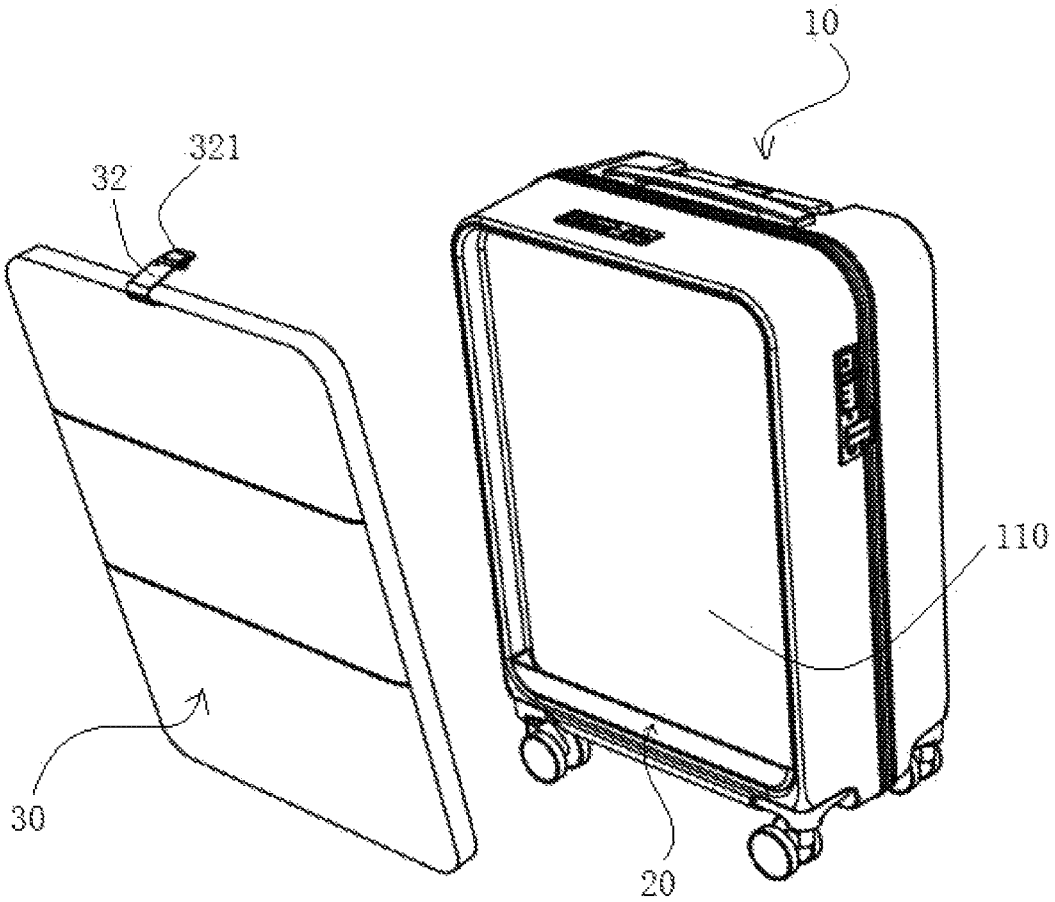
FIG. 4C illustrates the state that the detachable portion has not yet been assembled with the suitcase main body with the bottom stopper of the present invention.
Figure 4D:
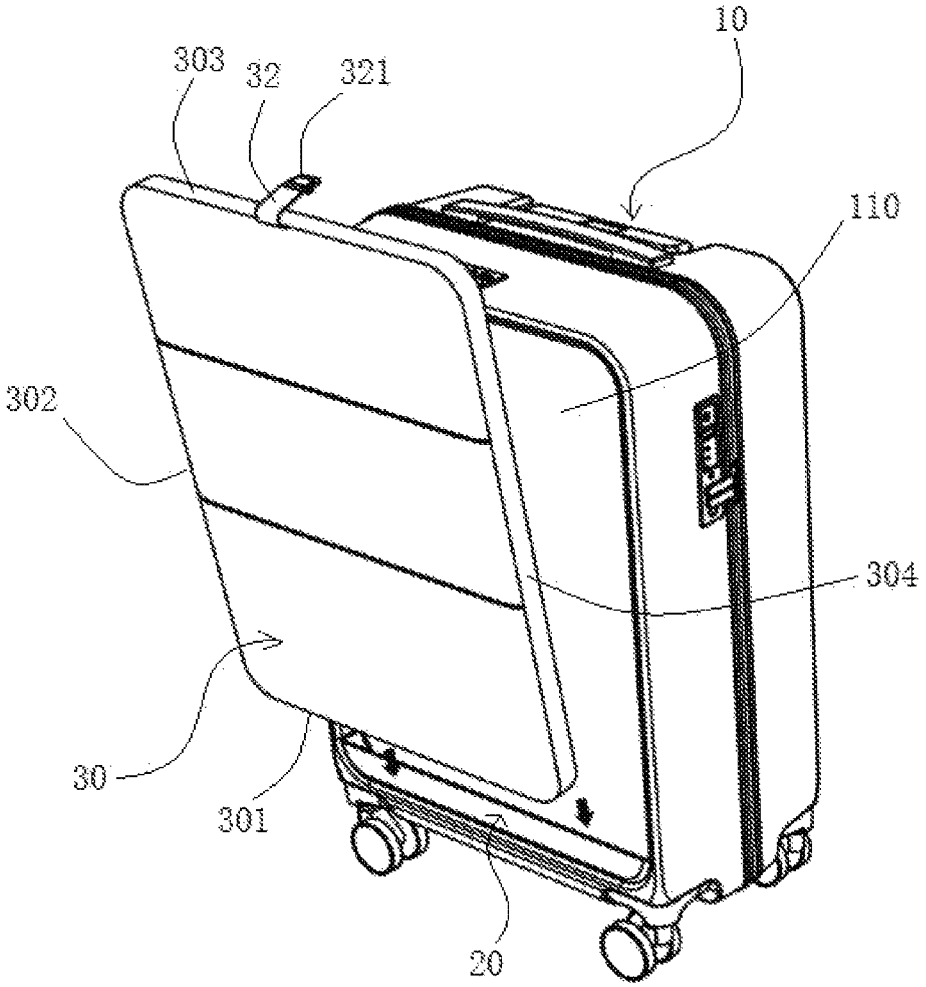
FIG. 4D illustrates the state that the detachable portion is being assembled with the suitcase main body with the bottom stopper of the present invention.
Figure 4E:
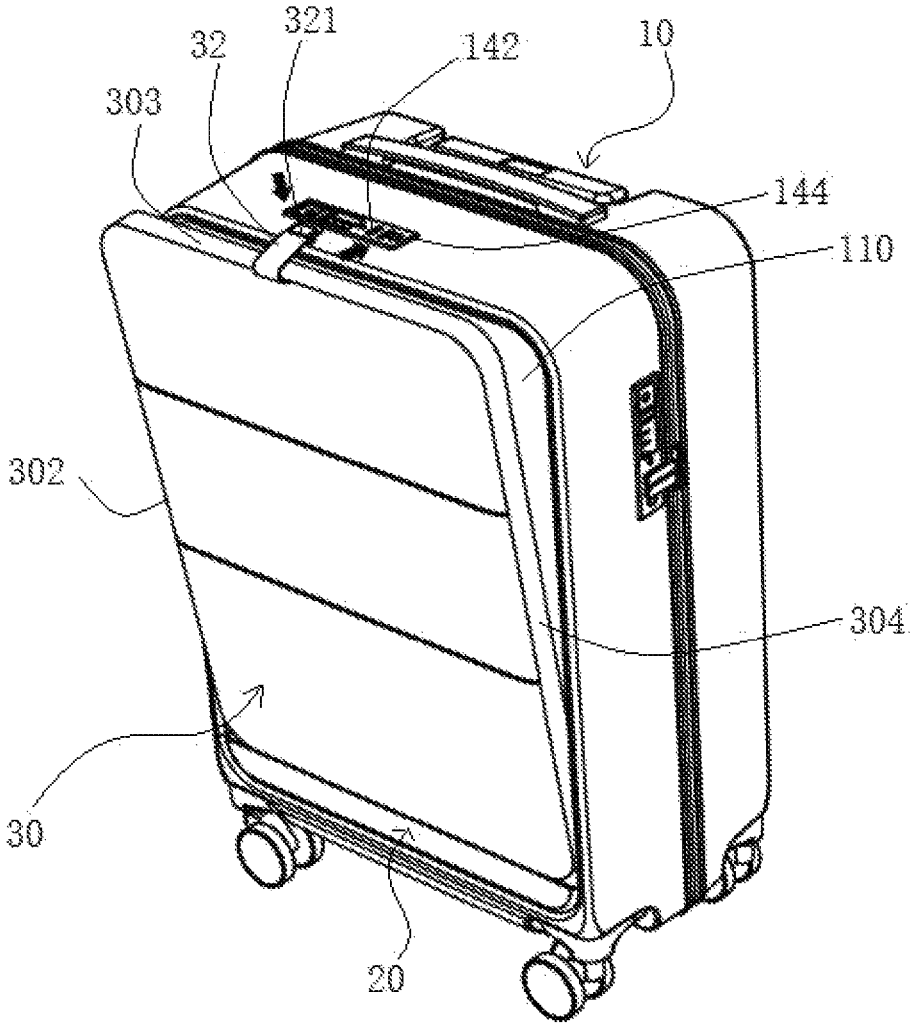
FIG. 4E illustrates the state that the lower end of the detachable portion has been placed within the inner space defined by the bottom stopper of the present invention.
Figure 4F:
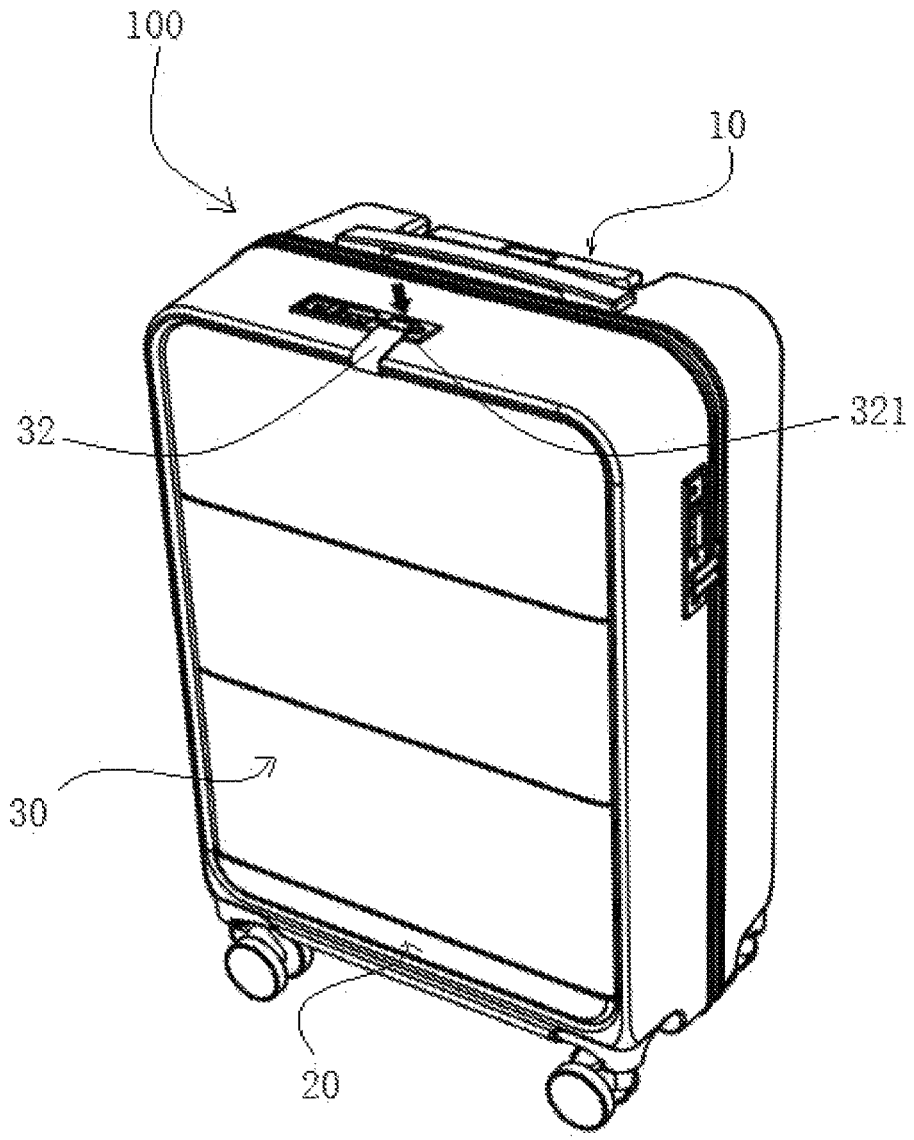
FIG. 4F illustrates the state that the detachable portion has been assembled onto the suitcase main body with the bottom stopper of the present invention.

The suitcase main body 10 may be formed of a conventional material, such as ABS, PVC, an aluminum alloy, PC, EVA, or the like. The concaved cavity 110 may be formed by, for example, a molding process. The locking slots 142, 144 are configured to receive and lock the inserting pieces as illustrated in FIG. 3B. The locking slots 142, 144 may be formed as an integral part with the customs lock 120 and the combination lock 130, and then assembled onto the upper end of the suitcase main body 10, near the concaved cavity 110.

The suitcase of the present invention further comprises a bottom stopper 20 secured to the bottom wall of the concaved cavity 110. As shown in FIGS. 2A, 2B, 4A-4F, the bottom stopper 20 includes a front stop 22, side stops 21, 23 and a bottom stop 25. The front stop 22, side stops 21, 23 and a bottom stop 25 are joined together to form an integral bottom stopper 20. The lower surface of the bottom stop 25 of the bottom stopper 20 is provided with two projections 24, 26, which correspond respectively to the two assembly holes 11014, 11016 provided in the bottom wall 1101 of the concaved cavity 110. As shown in FIGS. 4A-4F, the bottom stopper 20 is secured to the bottom wall 1101 of the concaved cavity 110 when the projections 24, 26 are inserted and secured into the assembly holes 11014, 11016.

Alternatively, the bottom stopper 20 may include merely the front stop 22 and the bottom stop 25, and the front stop 22 and the bottom stop 25 can be formed as an integral part.

The suitcase 100 of the present invention may further comprises a detachable portion 30. As shown in FIGS. 3A, 3B, 4C-4F, the detachable portion 30 is a functional component which can be detached from the suitcase main body 10 as required so that another detachable portion having a different function can be attached and secured to the suitcase main body 10.

As illustrated in the Figures, the detachable portion 30 includes a detachable portion main body 31 and a securing structure 32 at the top end of the detachable portion main body 31. The securing structure 32 is illustrated in the Figures as a securing belt. One end of the securing belt is fixedly connected to the detachable portion main body 31, while the other end 321 thereof is attached with inserting pieces 322, 324. Preferably, the back side 33 of the detachable portion main body 31 (i.e., the side that is within the concaved cavity 110 and invisible) may also has a tightening belt 34 to facilitate securing of objects.

The detachable portion main body 31 includes a lower side 301, an upper side 303, a left side 302 and a right side 304. When it is put in place, the lower side 301, and a portion of the left side 302 and the right side 304 will rest on the upper surface of the bottom stop 25 of the integral bottom stopper 20, and within an inner space defined by the bottom stopper 20 formed by the front stop 22, the side stops 21, 23 and the bottom stop 25 which are joined as an integral part, and the upper side 303, and the remaining portion of the left side 302 and the right side 304 are matched respectively with the upper wall 1103, the left wall 1102 and the right wall 1104 of the concaved cavity 110. By way of example, when the detachable portion main body 31 is put in place, the gap between the upper side 303 and the upper wall 1103, the gap between the left side 302 and the left wall 1102, and the gap between the right side 304 and the right wall 1104 are smaller than 2 mm.

The projections 24, 26 are in tight fit with the assembly holes 11014, 11016, and the tight fit could be carried out in any means that is known to one skilled in the art. Such as for example, the projections 24, 26 may be provided as a hollow structure having an outer diameter that is slightly greater than the inner diameter of the assembly holes 11014, 11016. The projections 24, 26 and the integral bottom stopper 20 may be formed with an elastic material, such as but without limitation to an EVA material having a higher amount of VA.

The engagement of the inserting pieces 322, 324 with the locking slots 142, 144 should be in such a way that the inserting pieces 322, 324 would not be released readily from the locking slots 142, 144 upon the inserting pieces 322, 324 being inserted into the locking slots 142, 144; however, when a significant force, for example, a significant pull force, is exerted on the inserting pieces 322, 324, they can be released from the locking slots 142, 144. The structures for achieving this effect would be well known to one skilled in the art. By way of example, the inserting pieces 322, 324 may be of a hollow structure, and may be formed with a wear-resistant elastic material, with the outer size thereof being slightly greater than the inner size of the locking slots 142, 144. Another example is that a structure similar to plug-socket may also be used.

In order to ensure a reliable connection between the detachable portion 30 and the suitcase main body 10, the back side 33 of the detachable portion and the back portion 1105 of the concaved cavity may be further provided with snap-on devices that can be engaged with one another. As used herein, the back portion of the concaved cavity refers to the portion of the concaved cavity which would face the user when the detachable portion 30 is detached from the concaved cavity of the suitcase main body 10.

Figure 5:
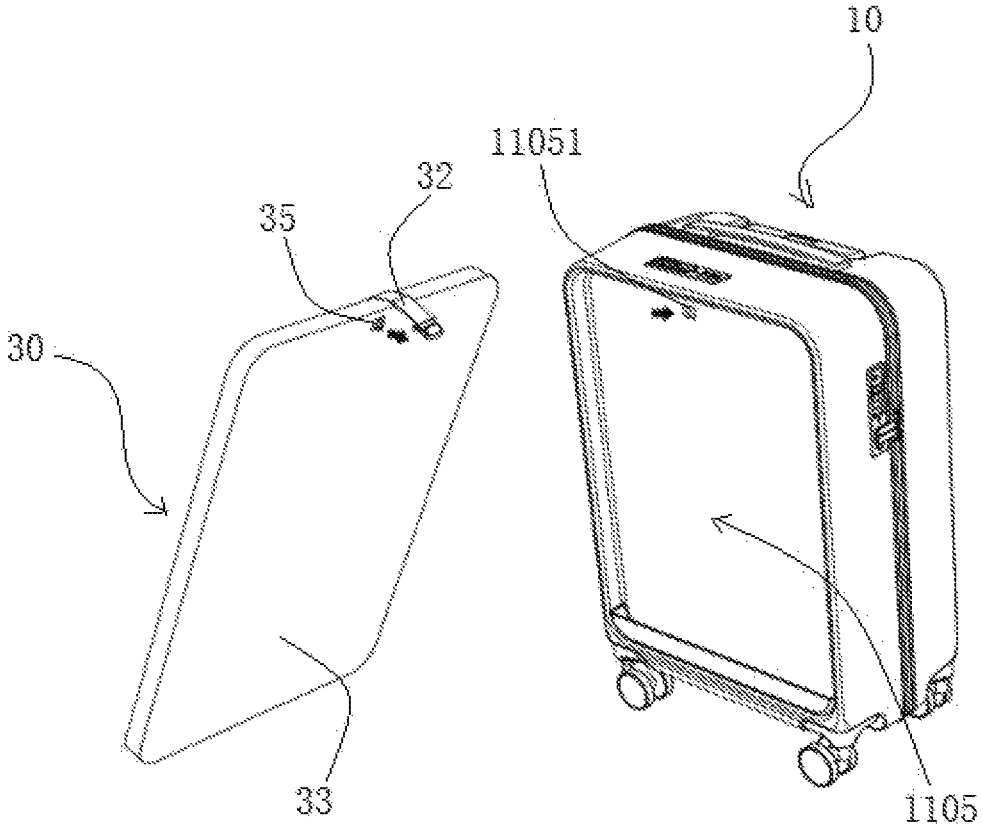
FIG. 5 illustrates a suitcase in the separated state, wherein the back side of the detachable portion and the back portion of the concaved cavity are also provided with corresponding releasable locking means that have not been engaged with one another.

As shown in FIG. 5, a snap-on head 35 is provided on the back side 33 of the detachable portion 30, and a snap-on slot 11051 is provided in the back portion 1105 of the concaved cavity. Upon insertion of the snap-on head 35 into the snap-on slot 11051, a snap-on engagement is formed. Alternatively, the snap-on head may also be provided on the back portion 1105 of the concaved cavity, and the snap-on slot is provided in the back side 33 of the detachable portion 30.

The snap-on engagement is releasable, and such releasable snap-on devices would be well known to one skilled in the art. Accordingly, a further detailed description thereof would not be set forth herein.

It should be understood that the securing structure and locking means described herein may also be implemented with other securing or locking means known in the art, as long as such a securing or locking means is releasable.

For example, in an embodiment as illustrated in FIGS. 6A, 6B, 7A, 7B, 8A and 8B, the securing mechanism 32' at the top end of the detachable portion comprises a ring-shaped insert piece 322', a support piece 321', a fastening screw 323' and a rigid plate 324'. The ring-shaped insert piece 322' is fixedly attached to the support piece 321' and is secured to the back side of the top end of the detachable portion 30 by means of the rigid plate 324', using the support piece 321' and the fastening screw 323'. The rigid plate 324' can be, for example but without limitation to, an aluminum alloy plate.

Figure 7A:
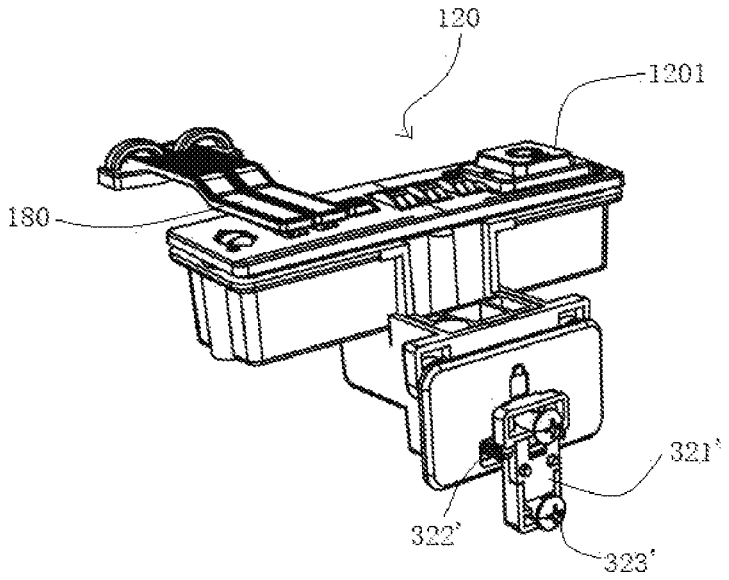
FIG. 7A illustrates a schematic diagram of the securing mechanism of FIG. 6A and FIG. 6B that is locked into the lock hole of the lockset.
Figure 7B:
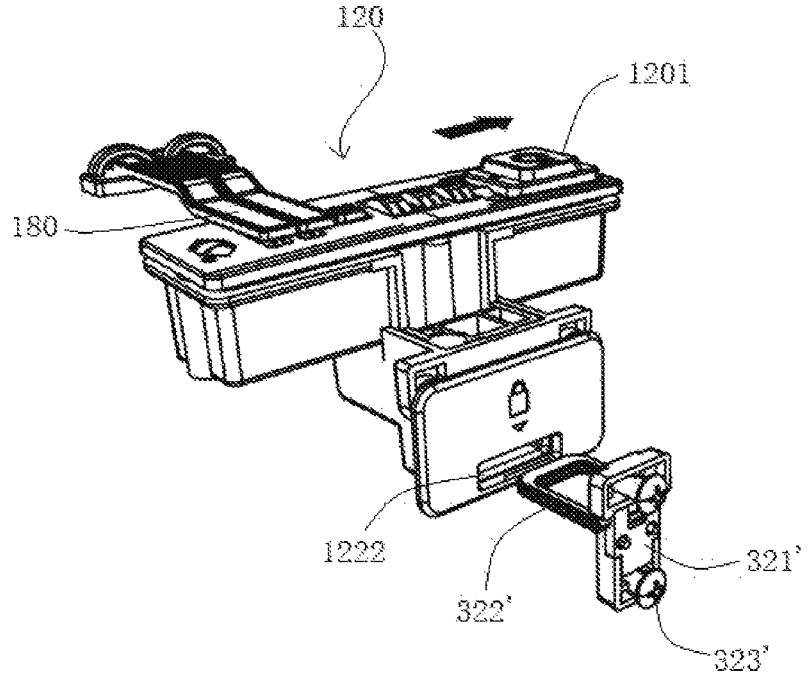
FIG. 7B illustrates a schematic diagram of the securing mechanism of FIG. 6A and FIG. 6B that is unlocked from the lock hole of the lockset.
Figure 8A:
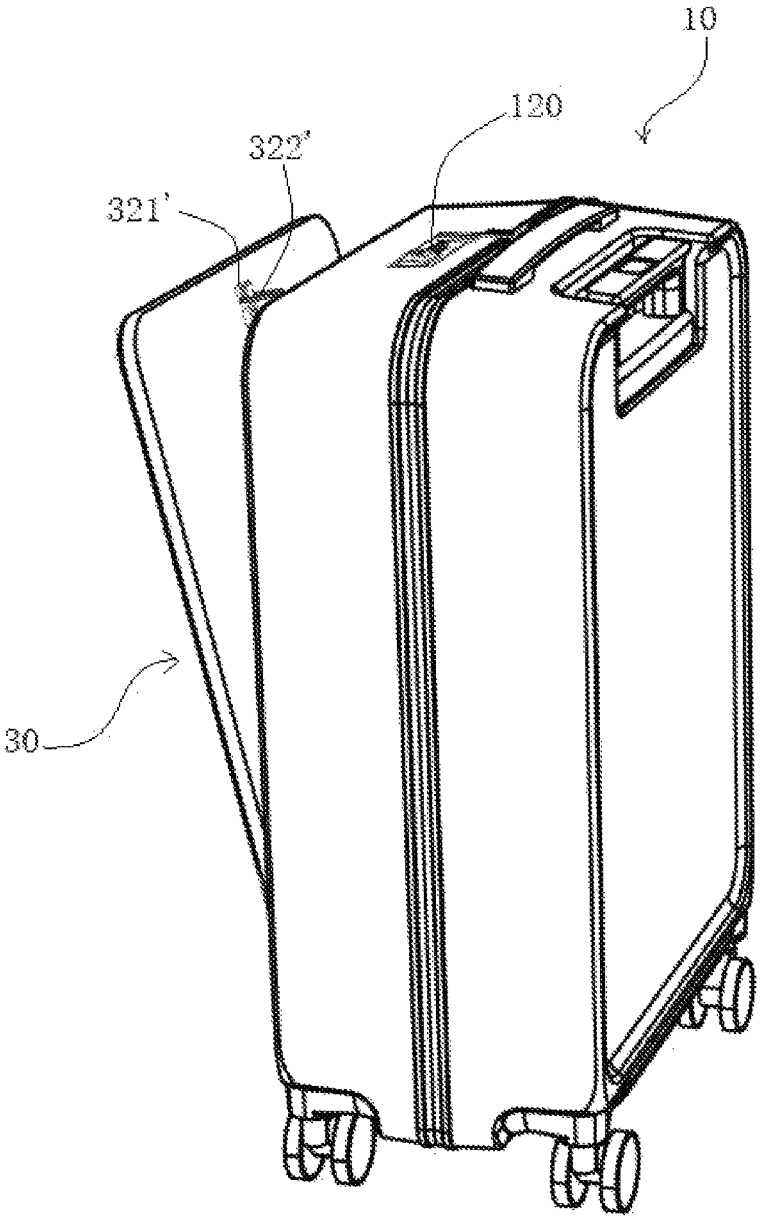
FIG. 8A illustrates a state in which the detachable portion with the securing mechanism of FIG. 6A
Figure 8B:
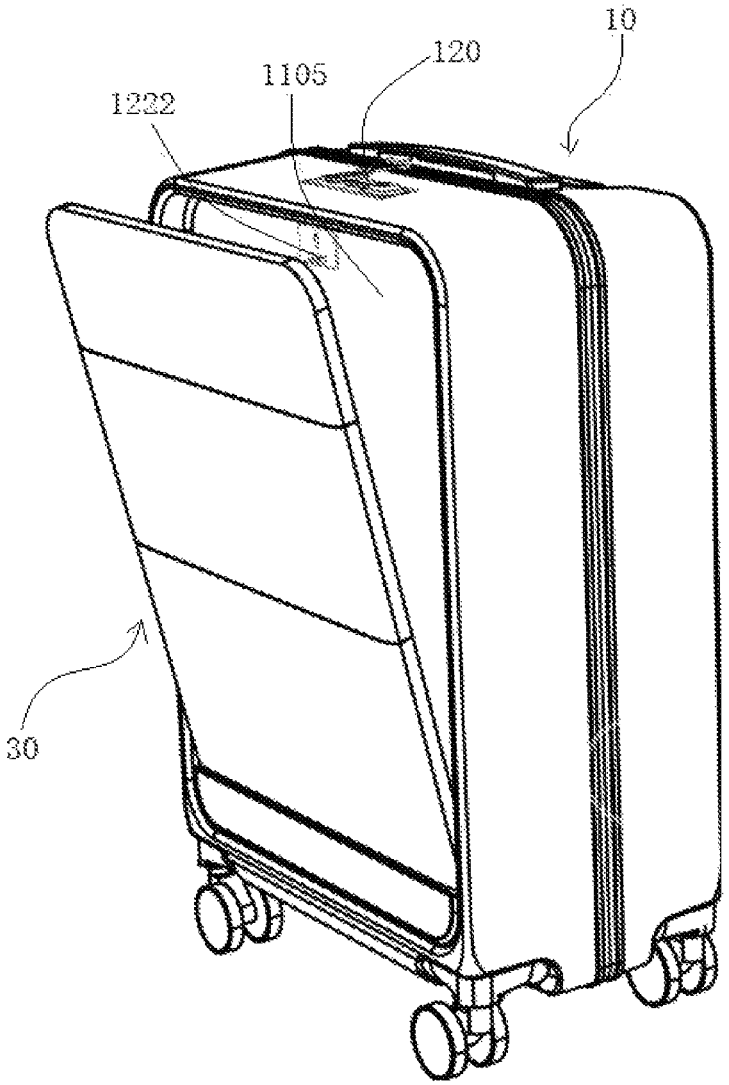
FIG. 8B illustrates a state in which the detachable portion with the securing mechanism of FIG. 6A

The suitcase main body 10 is mounted at the top end thereof a lockset 120 that is to be engaged with the securing mechanism 32'. A lock hole 1222 of the lockset 120 is exposed at the back side 1105 of the concaved cavity. When the ring-shaped insert piece 322' is inserted into the lock hole 1222, the ring-shaped insert piece 322' is locked within the lock hole 1222, as shown in FIG. 7A. The switch 1201 of the lock set 120 can be used to unlock the ring-shaped insert piece 322' from the lock hole 1222. As shown in FIG. 7B, when the switch 1201 is moved along the direction indicated by the arrow, i.e., to the right, from the first position to the second position, the ring-shaped insert piece 322' will be unlocked from the lock hole 1222, so as to detach the detachable portion 30' from the suitcase main body 10. As used herein, the first position means the position of the switch that the ring-shaped insert piece 322' is engaged with the lockset and thus locked within the lock hole of the lockset, while the second position means the position of the switch that the ring-shaped insert piece 322' is disengaged with the lockset and thus unlocked or released from the lock hole of the lockset.

For example, only the lockset 120 can be commercially available from YiFeng Manufacturing Co., Ltd. (Guangdong, China). As shown in FIGS. 7A and 7B, the lockset can not only lock and unlock the securing mechanism 32' but can also lock and unlock the zipper pulls 180. Specifically, when the switch of FIG. 7A is moved along the direction apposite the direction indicated by the arrow of FIG. 8, i.e., moved to left, the zipper pulls 180 can be unlocked from the lockset. However, it should be understood that the lock set of the present invention is not limited to the lockset particularly set forth above.

Figure 6A:
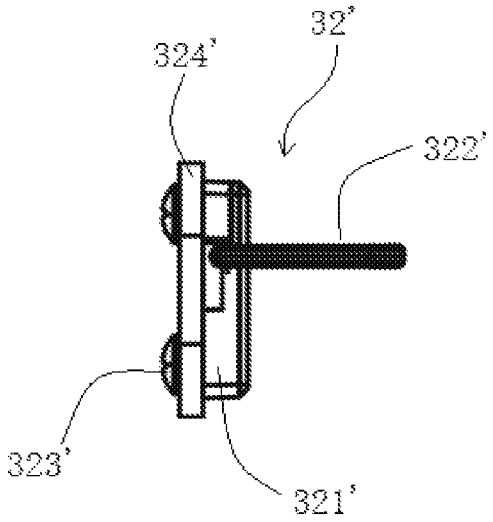
FIG. 6A illustrates a schematic diagram of an embodiment of the securing mechanism of the present invention.
Figure 6B:
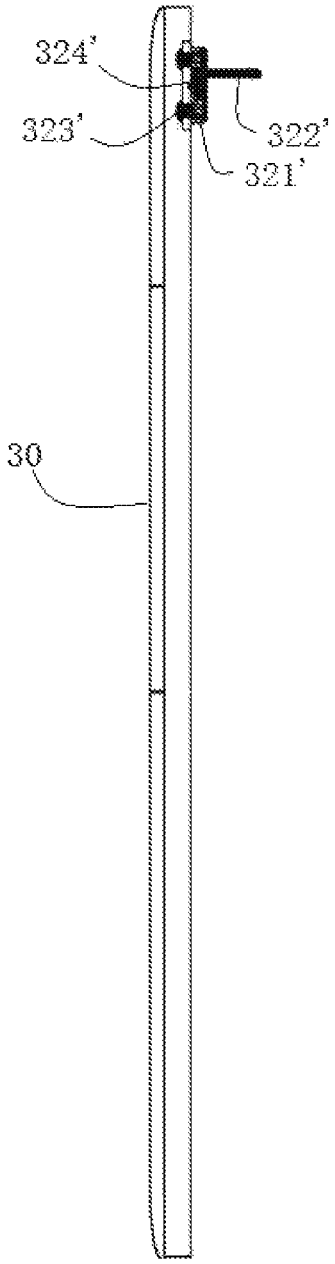
FIG. 6B illustrates a schematic sectional view of the securing mechanism that is connected with the detachable portion of the present invention.

As illustrated in FIGS. 6A and 6B, the ring-shaped insert piece 322' is fixedly attached to the support piece 321' and is secured to the back side of the top end of the detachable portion 30 by means of the rigid plate 324', using the support piece 321' and the fastening screws 323'. The rigid plate 324' can be covered by the forming material of the detachable portion 30, and thus would be invisible from outside. The rigid plate 324' can be secured to the back side of the top end of the detachable portion 30 and include through holes for the fastening screws 323' to pass through. Securing the rigid plate 324' to the back side of the top end of the detachable portion 30 can be carried out by any means known to one skilled in the art and will not be described in detail for simplicity.

Having described the preferred embodiments of the invention, it is understood that the invention defined by the appended claims is not to be limited by particular details set forth in the above description, as many apparent variations thereof are possible without departing from the spirit or scope thereof.

What is claimed is:

1. A suitcase with a detachable portion, comprising:

a suitcase main body with an upper side and a lower side, wherein a concaved cavity is provided in at least one of the upper side and the lower side, a bottom wall of the concaved cavity is provided with at least one assembly hole, and a top end of the main body is provided with a locking means, the suitcase further comprising:

a detachable portion having a shape and size adapted to the concaved cavity, and the detachable portion having a top end that is provided with a securing mechanism;

an integral bottom stopper including at least a front stop and a bottom stop that is joined with the front stop, the bottom stop has a lower surface that is provided with at least one projection, and the bottom stop is secured to the bottom wall of the concaved cavity when the at least one projection is inserted and secured into the at least one assembly hole;

wherein when the detachable portion is put in place and secured within the concaved cavity, at least a part of the detachable portion is confined within an inner space defined by the front stop and the bottom stop of the bottom stopper, and the securing mechanism at the top end of the detachable portion is releasably secured to the locking means.

2. The suitcase with a detachable portion according to claim 1, wherein the bottom wall of the concaved cavity is provided with two assembly holes, and the lower surface of the bottom stop is provided with two projections corresponding to the two assembly holes.

3. The suitcase with a detachable portion according to claim 2, wherein the securing mechanism at the top end of the detachable portion comprises at least one inserting piece, and the locking means is at least one locking slot engaged with the at least one inserting piece.

4. The suitcase with a detachable portion according to claim 3, wherein the two projections are of a hollow structure and the outer sizes of the projections are greater than the inner sizes of the two assembly holes, and the projections are formed of an elastic material.

5. The suitcase with a detachable portion according to claim 3, wherein the inserting piece is of a hollow structure and the outer size of the inserting piece is greater than the inner size of the locking slot, and the inserting piece is formed of a wear-resistant elastic material.

6. The suitcase with a detachable portion according to claim 3, wherein the securing mechanism comprises a securing belt having one end connected to the top end of the detachable portion, and the other end of the securing belt is fixedly connected with the inserting piece.

7. The suitcase with a detachable portion according to claim 3, wherein the inserting piece is of a solid structure and the locking slot is provided with an elastic piece therein for securing the inserting piece.

8. The suitcase with a detachable portion according to claim 3, wherein two inserting pieces and two locking slots corresponding to the two inserting pieces are provided.

9. The suitcase with a detachable portion according to claim 1, wherein a back side of the detachable portion and a back portion of the concaved cavity are provided with a releasable second locking means in cooperation with one another.

10. The suitcase with a detachable portion according to claim 1, wherein the detachable portion and the main body of the suitcase are in the disconnected state.

11. The suitcase with a detachable portion according to claim 3, wherein the securing mechanism at the top end of the detachable portion comprises the at least one inserting piece that is a ring-shaped insert piece, a support piece, a fastening screw and a rigid plate, the ring-shaped insert piece is fixedly attached to the support piece, and secured, using the support piece and the fastening screw, to the back side of the top end of the detachable portion by means of the rigid plate; the locking means being a lockset having the at least one locking slot formed as a lock hole to be engaged with the ring-shaped insert piece.

12. The suitcase with a detachable portion according to claim 11, wherein the lockset comprises a switch having a first position and a second position; in the first position, the ring-shaped insert piece is locked into the lock hole of the lock set, and when the switch is moved from the first position to the second position, the ring-shaped insert piece is unlocked from the lock hole of the lockset.

13. The suitcase with a detachable portion according to claim 11, wherein the rigid plate is an aluminum plate, and the aluminum plate is secured to the back side of the top end of the detachable portion.

* * * * *